US011885319B2

(12) United States Patent
Song

(10) Patent No.: US 11,885,319 B2
(45) Date of Patent: Jan. 30, 2024

(54) SWASH PLATE-TYPE COMPRESSOR

(71) Applicant: Hanon Systems, Daejeon (KR)

(72) Inventor: Seyoung Song, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 326 days.

(21) Appl. No.: 17/296,838

(22) PCT Filed: Dec. 20, 2019

(86) PCT No.: PCT/KR2019/018211
§ 371 (c)(1),
(2) Date: May 25, 2021

(87) PCT Pub. No.: WO2020/138863
PCT Pub. Date: Jul. 2, 2020

(65) Prior Publication Data
US 2022/0003224 A1 Jan. 6, 2022

(30) Foreign Application Priority Data
Dec. 27, 2018 (KR) ..... 10-2018-0170683

(51) Int. Cl.
*F04B 27/08* (2006.01)
*F04B 27/10* (2006.01)

(52) U.S. Cl.
CPC ..... *F04B 27/1072* (2013.01); *F04B 27/0873* (2013.01)

(58) Field of Classification Search
CPC ..... F04B 27/1072; F04B 27/0873; F04B 27/0804; F04B 27/0865; F04B 27/22; F04B 27/14; F04B 27/08
See application file for complete search history.

(56) References Cited

U.S. PATENT DOCUMENTS 6,659,738 B2 * 12/2003 Iwanami ..... F04C 18/0215 417/410.5
6,899,013 B2 * 5/2005 Ebbing ..... F04B 27/1072 74/60
8,152,483 B2 * 4/2012 Kawamura ..... F04B 27/1072 417/269

(Continued)

FOREIGN PATENT DOCUMENTS

JP 2006009627 A 1/2006
JP 2009068358 A 4/2009
JP 2013245632 A 12/2013

(Continued)

*Primary Examiner* — Dustin T Nguyen
(74) *Attorney, Agent, or Firm* — Shumaker, Loop & Kendrick, LLP; James D. Miller

(57) ABSTRACT

A swash plate compressor including rotor arms protruding from a rotor toward a swash plate and having rotor arm holes; swash plate arms protruding from the swash plate toward the rotor and having swash plate arm holes; and a link arm hingedly coupled to the rotor arms and the swash plate arms by link pins, in which the swash plate arms include a first swash plate arm positioned at a side in rotation direction of the shaft based on the link arm; and a second swash plate arm positioned at a side in a direction opposite to the rotation direction of the shaft based on the link arm, and in which the first swash plate arm has higher wear resistance than the second swash plate arm.

15 Claims, 10 Drawing Sheets

(56) References Cited

U.S. PATENT DOCUMENTS

2009/0246050 A1* 10/2009 Miyaji ..... F04B 27/1072
417/437

FOREIGN PATENT DOCUMENTS

| | | | |
|---|---|---|---|
| KR | 20080106793 | A | 12/2008 |
| KR | 20100081065 | A | 7/2010 |
| KR | 101886725 | B1 | 8/2018 |

* cited by examiner

SWASH PLATE-TYPE COMPRESSOR

REFERENCE TO RELATED PATENT APPLICATIONS

This patent application is a United States national phase patent application based on PCT/KR2019/018211 filed on Dec. 20, 2019, which claims the benefit of Korean Patent Application No. 10-2018-0170683 filed on Dec. 27, 2018, the entire contents of both of which are hereby incorporated herein by reference.

TECHNICAL FIELD

The present disclosure relates to a swash plate compressor, and more particularly, to a swash plate compressor having a swash plate arm disposed at a side in a rotation direction of a shaft and having improved wear resistance.

BACKGROUND ART

In general, compressors mounted in cooling systems for a vehicle and serving to compress a refrigerant have been developed in various forms, and the compressors are classified into a reciprocating compressor having a component that compresses a refrigerant while reciprocating, and a rotary compressor having a component that compresses a refrigerant while rotating.

In this case, the reciprocating compressors are classified into a crank compressor that transmits driving power from a driving source to a plurality of pistons using a crank, a swash plate compressor that transmits driving power from a driving source to a rotary shaft on which a swash plate is installed, and a wobble plate compressor that uses a wobble plate. The rotary compressors are classified into a vane rotary compressor that uses a rotating rotary shaft and vanes, and a scroll compressor that uses an orbiting scroll and a fixed scroll.

Meanwhile, the swash plate compressors are classified into a fixed capacity compressor in which an installation angle of a swash plate is fixed, and a variable capacity compressor that may change a discharge capacity by changing an inclination angle of a swash plate.

FIG. 1 illustrates components 1 related to an inclined rotation of a swash plate mounted in a variable capacity swash plate compressor in the related art.

When a pulley connected to an engine rotates, a shaft 2 connected to a central shaft of the pulley is rotated. A rotor 3 is fastened to the shaft 2, and rotor arms 4 are provided on the rotor 3. The rotor arms 4 have rotor arm holes 4*a* formed in the form of holes slidably elongated in a longitudinal direction thereof.

Further, swash plate arms 6 are provided at a side of a swash plate 7 facing the rotor, and the swash plate arms 6 have swash plate arm holes 6*a*. The rotor arm holes 4*a* and the swash plate arm holes 6*a* are connected to one another with a link pin 5.

In this connection structure, when the rotor 3 rotates as the shaft 2 rotates, the link pin 5 slides along the insides of the rotor arm holes 4*a*, thereby changing an inclination angle of the swash plate 7.

However, in the case of the structure in the related art, when the shaft 2 rotates in the direction indicated by the arrow, a strong force generated by the rotation of the shaft 2 is applied to facing surfaces 51 of the rotor arm 4 and the swash plate arm 6 which are positioned at a side in a rotation direction and in close contact with each other. In this state, as the link pin 5 slides, the facing surfaces 51 are relatively severely abraded compared to facing surfaces S2 of the rotor arm 4 and the swash plate arm 6 which are positioned at a side in a direction opposite to the rotation direction.

SUMMARY

The present disclosure has been made in an effort to solve the above-mentioned problems in the related art, and an object of the present disclosure is to provide a swash plate compressor having a swash plate arm disposed at a side in a rotation direction of a shaft and having improved wear resistance.

In order to achieve the above-mentioned object, the present disclosure provides a swash plate compressor including: a casing; a shaft rotatably disposed in the casing; a rotor fastened to the shaft and configured to rotate integrally with the shaft; a swash plate configured to rotate integrally with the rotor in conjunction with the rotor; a piston configured to reciprocate in a cylinder bore formed in the casing in conjunction with the swash plate, the piston being configured to define a compression chamber together with the cylinder bore; and an inclination adjusting means disposed between the rotor and the swash plate so as to operate in conjunction with the rotor and the swash plate, the inclination adjusting means being configured to adjust an inclination angle of the swash plate in accordance with the rotation of the rotor, in which the inclination adjusting means includes: rotor arms protruding from the rotor toward the swash plate and having rotor arm holes; swash plate arms protruding from the swash plate toward the rotor and having swash plate arm holes; and a link arm hingedly coupled to the rotor arms and the swash plate arms by link pins, in which the swash plate arms include: a first swash plate arm positioned at a side in rotation direction of the shaft based on the link arm; and a second swash plate arm positioned at a side in a direction opposite to the rotation direction of the shaft based on the link arm, and in which the first swash plate arm has higher wear resistance than the second swash plate arm.

In addition, in the embodiment of the present disclosure, the first swash plate arm may include a heat-treated part.

In addition, in the embodiment of the present disclosure, the first swash plate arm may include: a first base portion connected to the swash plate; a first tip portion protruding from the first base portion toward the rotor and having a first swash plate arm hole; and a heat-treated part provided on the first tip portion, and the second swash plate arm may include: a second base portion connected to the swash plate; and a second tip portion protruding from the second base portion toward the rotor and having a second swash plate arm hole.

In addition, in the embodiment of the present disclosure, when imaginary planes including a center point of the rotor arm hole and a center point of the first swash plate arm hole are referred to as reaction force interaction planes, the heat-treated part may be provided on a portion of the first tip portion that includes the reaction force interaction planes.

In addition, in the embodiment of the present disclosure, when a reaction force interaction plane defined by the center point of the rotor arm hole and the center point of the first swash plate arm hole when the inclination angle of the swash plate is largest is referred to as a first reaction force interaction plane and a reaction force interaction plane defined by the center point of the rotor arm hole and the center point of the first swash plate arm hole when the inclination angle of the swash plate is smallest is referred to as a second reaction force interaction plane, the heat-treated part may be provided on a portion of the first tip portion that includes the first reaction force interaction plane and the second reaction force interaction plane.

In addition, in the embodiment of the present disclosure, when imaginary planes on which the center point of the first swash plate arm hole and the swash plate are disposed to be perpendicular to each other are referred to as perpendicular planes, the heat-treated part may be provided on a portion of the first tip portion that includes the perpendicular planes.

In addition, in the embodiment of the present disclosure, when a perpendicular plane defined by the center point of the first swash plate arm hole and the swash plate when the inclination angle of the swash plate is largest is referred to as a first perpendicular plane and a perpendicular plane defined by the center point of the first swash plate arm hole and the swash plate when the inclination angle of the swash plate is smallest is referred to as a second perpendicular plane, the heat-treated part may be provided on a portion of the first tip portion that includes the first perpendicular plane and the second perpendicular plane.

In addition, in the embodiment of the present disclosure, when a portion of the first tip portion, which intersects the first reaction force interaction plane when the inclination angle of the swash plate is largest, is referred to as a first boundary portion and a portion of the first tip portion, which intersects the second reaction force interaction plane when the inclination angle of the swash plate is smallest, is referred to as a second boundary portion, the heat-treated part may be provided on a portion that includes the first boundary portion and the second boundary portion.

In addition, in the embodiment of the present disclosure, when a portion of the first tip portion, which intersects the first reaction force interaction plane when the inclination angle of the swash plate is largest, is referred to as a first boundary portion and a portion of the first tip portion, which intersects the first perpendicular plane when the inclination angle of the swash plate is largest, is referred to as a second boundary portion, the heat-treated part may be provided on a portion that includes the first boundary portion and the second boundary portion.

In addition, in the embodiment of the present disclosure, the heat-treated part may be heat-treated by a high-frequency heat treatment or a laser heat treatment.

In addition, in the embodiment of the present disclosure, a size of the first swash plate arm may be larger than a size of the second swash plate arm.

In addition, in the embodiment of the present disclosure, an area of a facing surface of the first swash plate arm, which faces the link arm, may be larger than an area of a facing surface of the second swash plate arm which faces the link arm.

In addition, in the embodiment of the present disclosure, the first swash plate arm may include: a first base portion connected to the swash plate; and a first tip portion protruding from the first base portion toward the rotor and having a first swash plate arm hole, the second swash plate arm may include: a second base portion connected to the swash plate; and a second tip portion protruding from the second base portion toward the rotor and having a second swash plate arm hole, and an increased area part may be provided on a facing surface of the first tip portion which faces the link arm.

In addition, in the embodiment of the present disclosure, a coupling centerline of the rotor arm and the swash plate arm may be disposed to be eccentric in the rotation direction of the shaft with respect to a centerline of the shaft.

In addition, in the embodiment of the present disclosure, the coupling centerline of the rotor arm and the swash plate arm may be positioned within a range in which a compressive reaction force of the piston, which performs compression in accordance with an inclined rotation of the swash plate, is applied.

According to the present disclosure, the area of the facing surface of the swash plate arm disposed at the side in the rotation direction of the swash plate is relatively larger than the area of the facing surface of the swash plate arm disposed at the side in the direction opposite to the rotation direction of the swash plate in consideration of the rotation direction of the swash plate, such that the contact pressure concentrated on the swash plate arm disposed at the side in the rotation direction is dispersed, and as a result, wear resistance of the swash plate arm is improved.

In addition, the swash plate arm disposed at the side in the rotation direction of the swash plate is heat-treated by a high-frequency heat treatment or a laser heat treatment in consideration of the rotation direction of the swash plate. In this case, the heat treatment region is limited within a range of the maximum inclination angle of the swash plate in consideration of the reaction force interaction plane between the link arm and the swash plate arm. As a result, strength of a particular portion of the swash plate arm, to which a high force is applied locally, is increased, and thus wear resistance is improved.

DETAILED DESCRIPTION OF THE EMBODIMENTS

Hereinafter, exemplary embodiments of a swash plate compressor according to the present disclosure will be described in detail with reference to the accompanying drawings.

First, a basic configuration of the swash plate compressor, to which the present disclosure is applied, will be described with reference to FIG. 2. However, the present disclosure is not necessarily limited to the configuration, and a description of the swash plate compressor is effective only for the purpose of understanding the present disclosure.

Figure 1:
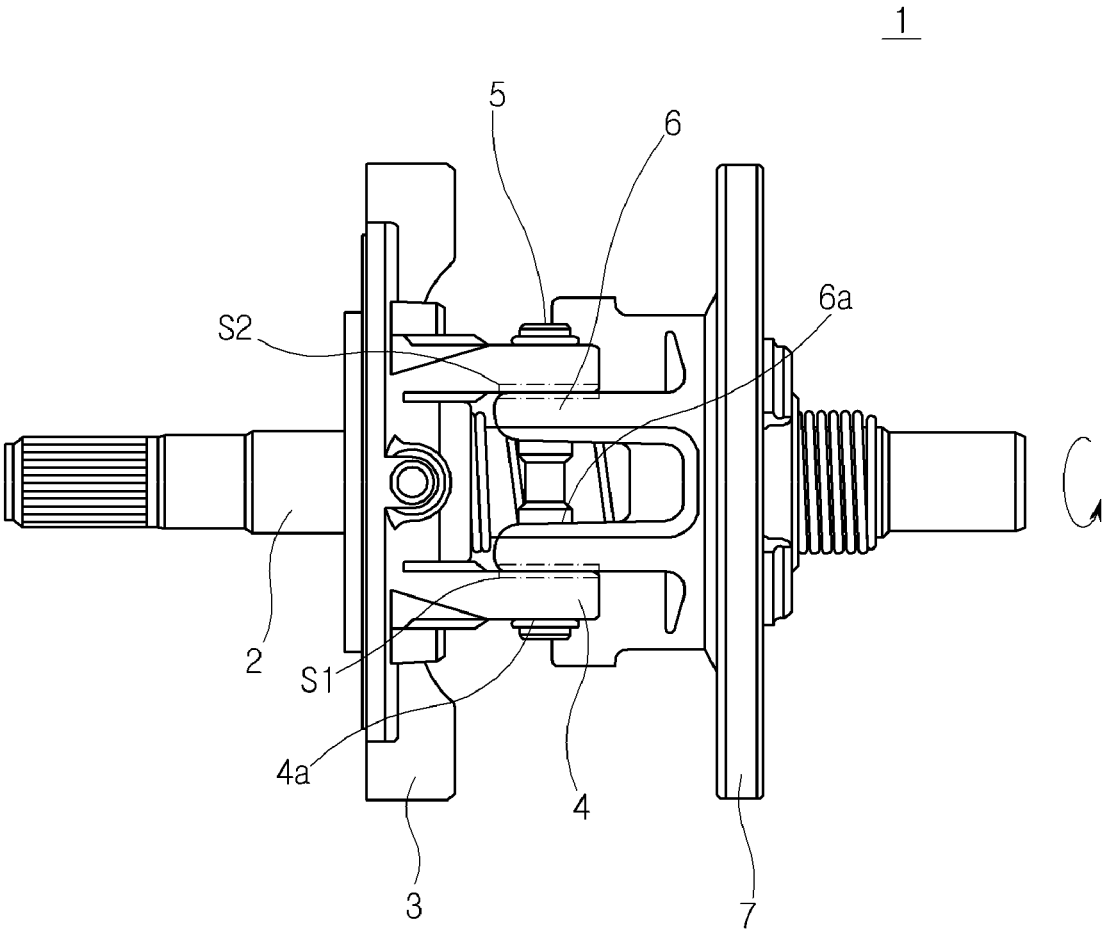
FIG. 1 PRIOR ART
FIG. 1 is a view illustrating an inclined rotation-coupling structure of a swash plate of a swash plate compressor in the related art.
Figure 2:
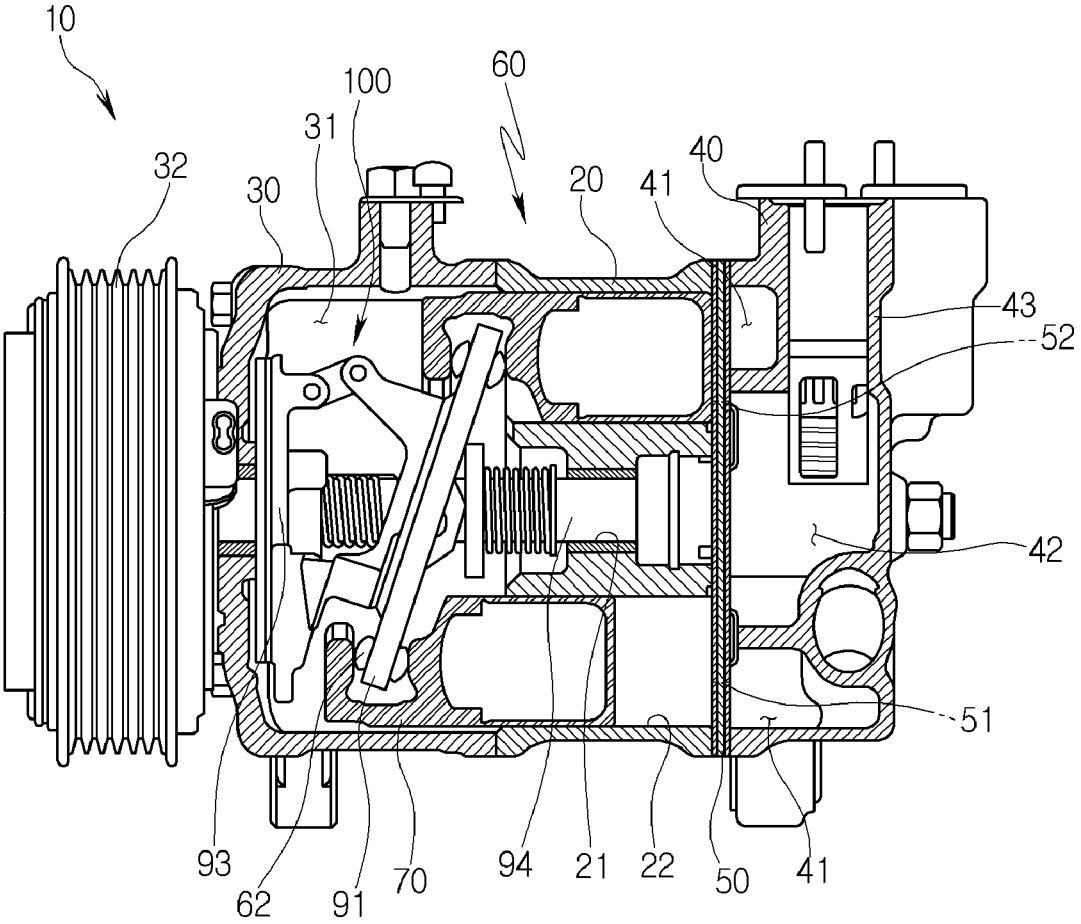
FIG. 2 is a cross-sectional view illustrating a structure of a swash plate compressor.

Referring to FIG. 2, a swash plate compressor 10 has a cylinder block 20 that partially defines an external appearance and a structure of the compressor 10. In this case, a center bore 21 is formed to penetrate a center of the cylinder block 20, and a shaft 94 is rotatably installed in the center bore 21.

The assembly of the cylinder block 20, a front housing 30, and a rear housing 40 may be referred to as a casing 60.

A plurality of cylinder bores 22 is formed to penetrate the cylinder block 20 so as to radially surround the center bore 21, and pistons 70 are rectilinearly reciprocably installed in the cylinder bores 22. In this case, the piston 70 is formed in a cylindrical shape, the cylinder bore 22 is a cylindrical space corresponding to the piston 70, and a refrigerant in the cylinder bore 22 is compressed by the reciprocating motion of the piston 70. The cylinder bore 22 and the piston 70 define a compression chamber.

The front housing 30 is coupled to a front portion of the cylinder block 20. A facing surface of the front housing 30, which faces the cylinder block 20, is recessed to define a crank chamber 31 in the front housing 30 together with the cylinder block 20.

A pulley 32 is rotatably installed on a front portion of the front housing 30, and the pulley 32 is connected to an external power source (not illustrated) such as an engine. The shaft 94 rotates in conjunction with the rotation of the pulley 32.

The rear housing 40 is coupled to a rear portion of the cylinder block 20. In this case, a discharge chamber 41 is formed in the rear housing 40, and the discharge chamber 41 is formed along a position adjacent to an outer circumferential edge of the rear housing 40 so as to selectively communicate with the cylinder bores 22.

Further, a suction port is formed at one side of the rear housing 40, and a check valve 43 is disposed in the suction port. The suction port is connected to a suction chamber 42 disposed at a central portion of the rear housing 40. However, the present disclosure is not necessarily limited thereto, and the positions may be changed in accordance with types of compressors.

In this case, a valve plate 50 is interposed between the cylinder block 20 and the rear housing 40, and the discharge chamber 41 communicates with the cylinder bores 22 through discharge ports 51 formed in the valve plate 50.

In addition, a rotor 93 is disposed on an outer circumferential surface of the shaft 94. The rotor 93 is operated in conjunction with a swash plate 91 by an inclination adjusting means 100 and connected to the respective pistons 70 through shoes 62 provided along a rim of the swash plate 91. The pistons 70 rectilinearly reciprocate in the cylinder bores 22 by the rotation of the swash plate 91.

In this case, in order to adjust the amount of refrigerant to be discharged from the compressor 10, an angle of the swash plate 91 with respect to the shaft 94 may be changed. To this end, an opening degree of a flow path, which allows the discharge chamber 41 and the crank chamber 31 to communicate with each other, is adjusted by a pressure adjusting valve (not illustrated).

The swash plate compressor in the related art configured as described above has a so-called radially symmetrical structure in which the plurality of cylinder bores 22 formed in the cylinder block 20 is disposed to be radially spaced apart from one another with respect to the shaft 94.

With the above-mentioned structure, when the swash plate 91 rotates, the plurality of pistons 70 moves to compress a fluid, and a valve door 52 is opened by a hydraulic pressure, such that the compressed fluid is pushed to the discharge chamber 41 through the discharge ports 51 of the valve plate 50.

The basic structure of the swash plate compressor 10 has been described above. Hereinafter, a detailed structure of the inclination adjusting means 100 will be described.

The inclination adjusting means 100 according to the present disclosure may be disposed to operate in conjunction with the rotor 93 and the swash plate 91 and provided to adjust an inclination angle of the swash plate 91 in accordance with the rotation of the rotor 93. The inclination adjusting means 100 may include rotor arms 110, swash plate arms 120 provided on a hub 170, and a link arm 160.

First, the rotor arms 110 may be disposed to protrude from the rotor 93 toward the swash plate 91, and rotor arm holes 111 each having a circular cross section may be formed in tip portions of the rotor arms 110. The swash plate arms 120 may be disposed to protrude from the swash plate 91 toward the rotor 93, and swash plate arm holes 133 and 143 each having a circular cross section may be formed in tip portions of the swash plate arms 120.

Further, the link arm 160 may be hingedly coupled to the rotor arms 110 and the swash plate arms 120 through link pins 161. The link pins 161 are inserted into the rotor arm holes 111 and the swash plate arm holes of the swash plate arms 120, respectively, such that the link arm 160 connects the rotor arms 110 and the swash plate arms 120.

In this case, the swash plate arms 120 may include a first swash plate arm 130 and a second swash plate arm 140.

The first swash plate arm 130 is positioned at a side in a rotation direction of the shaft 94 based on the link arm 160, and the second swash plate arm 140 is positioned at a side in a direction opposite to the rotation direction of the shaft 94 based on the link arm 160.

In the present disclosure, the first swash plate arm 130 may be configured to have higher wear resistance than the second swash plate arm 140. This configuration will be described below with reference to the drawings.

Figure 3A:
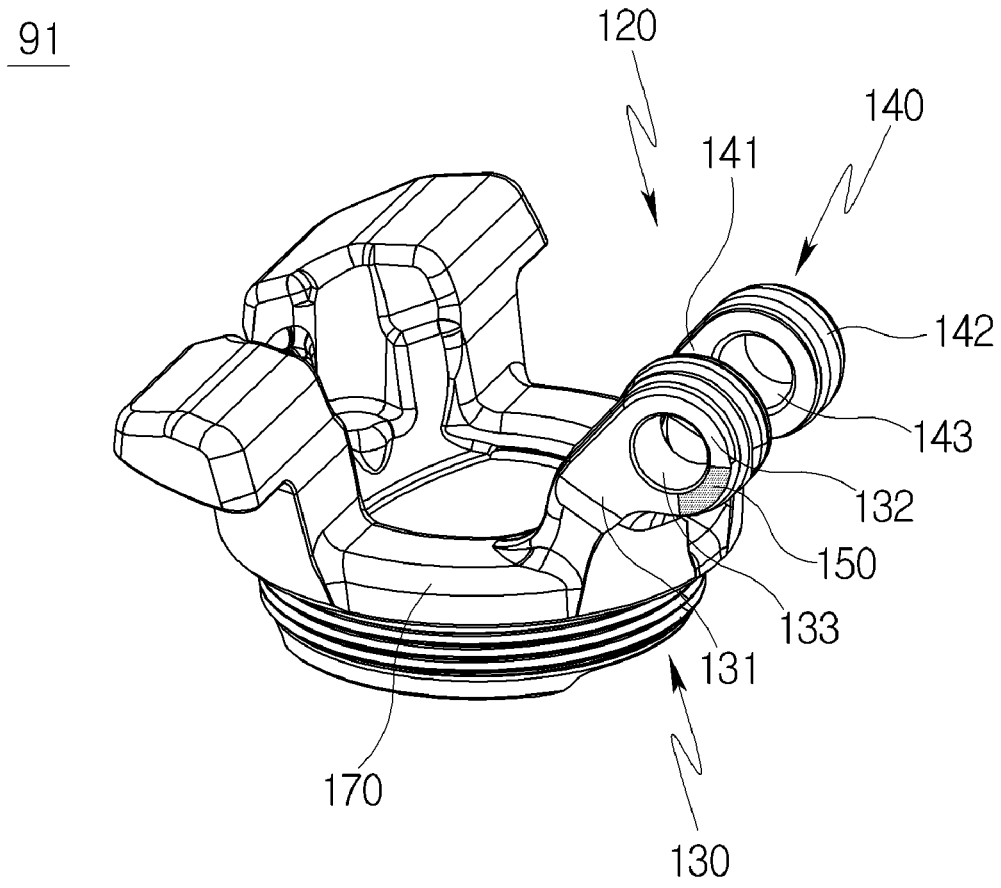
FIGS. 3A and 3B are views illustrating a heat-treated part of a swash plate arm according to the present disclosure.
Figure 3B:
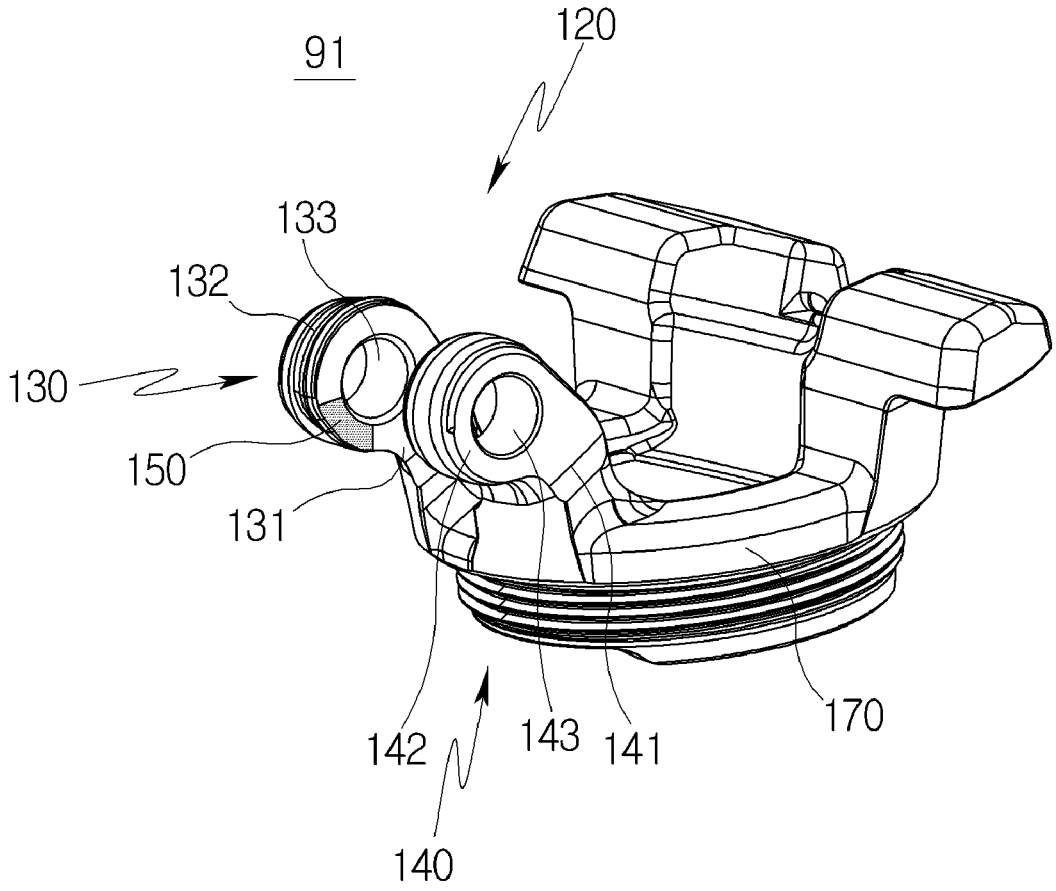
Figure 4:
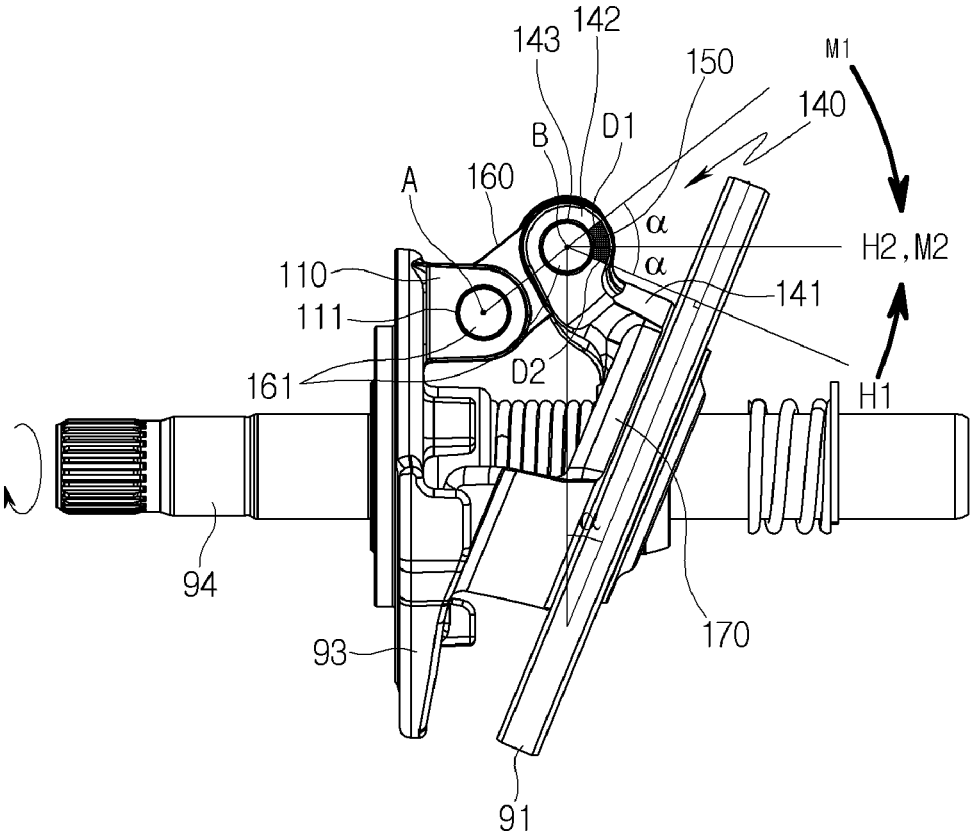
FIG. 4 is a view illustrating the heat-treated part of the swash plate arm according to the present disclosure in respect to an inclination angle of a swash plate.

FIGS. 3A and 3B are views illustrating a heat-treated part 150 of the swash plate arm 120 according to the present disclosure, and FIG. 4 is a view illustrating the heat-treated part 150 of the swash plate arm 120 according to the present disclosure in respect to the inclination angle of the swash plate 91.

In a first embodiment of the present disclosure, the configuration in which the first swash plate arm 130 has higher wear resistance than the second swash plate arm 140 may be a configuration in which the heat-treated part 150 is locally provided on the first swash plate arm 130 in order to improve strength of a metal material. The heat-treated part 150 may be made using a high-frequency heat treatment or a laser heat treatment.

Specifically, the first swash plate arm 130 may include a first base portion 131, a first tip portion 132, and the heat-treated part 150.

The first base portion 131 may be a portion connected to the swash plate 91. The first tip portion 132 may be a portion protruding from the first base portion 131 toward the rotor 93, and the first swash plate arm hole 133 having a circular cross section may be formed in the first tip portion 132. The heat-treated part 150 may be formed on the first tip portion 132.

When the rotor 93 rotates integrally with the rotation of the shaft 94, the link arm 160 connecting the rotor arms 110 and the swash plate arms 120 rotates the swash plate 91 by being supplied with a rotational force. In this case, since the first swash plate arm 130 is disposed at the side in the rotation direction of the swash plate 91 and the second swash plate arm 140 is disposed at the side in the direction opposite to the rotation direction of the swash plate 91, the link arm 160 applies strong force to the facing surface of the first swash plate arm 130 instead of the facing surface of the second swash plate arm 140.

Therefore, the heat-treated part 150 may be formed on the first swash plate arm 130 disposed at the side in the rotation direction of the swash plate 91, but the present disclosure is not necessarily limited thereto.

Further, the second swash plate arm 140 may include a second base portion 141 and a second tip portion 142.

The second base portion 141 may be a portion connected to the swash plate 91. The second tip portion 142 may be a portion protruding from the second base portion 141 toward the rotor 93, and the second swash plate arm hole 143 having a circular cross section may be formed in the second tip portion 142.

In this case, referring to FIG. 4, when imaginary planes including a center point A of the rotor arm hole 111 and a center point B of the first swash plate arm hole 133 are referred to as reaction force interaction planes M1 and M2, the heat-treated part 150 may be provided on a portion of the first tip portion 132 that includes the reaction force interaction planes M1 and M2. Particularly, the heat-treated part 150 may be provided on a portion of the first tip portion 132 that intersects the reaction force interaction planes M1 and M2.

In more detail, when a reaction force interaction plane defined by the center point of the rotor arm hole 111 and the center point of the first swash plate arm hole 133 when the inclination angle of the swash plate 91 is a maximum angle (e.g., an angle of $\alpha$) is referred to as the first reaction force interaction plane M1 and a reaction force interaction plane defined by the center point of the rotor arm hole 111 and the center point of the first swash plate arm hole 133 when the inclination angle of the swash plate 91 is a minimum angle (e.g., an angle of approximately 0°) is referred to as the second reaction force interaction plane M2, the heat-treated part 150 according to the present disclosure may be provided on the portion of the first tip portion 132 that includes the first reaction force interaction plane M1 and the second reaction force interaction plane M2. Particularly, the heat-treated part 150 may be formed on the portion of the first tip portion 132 that intersects the first reaction force interaction plane M1 and the second reaction force interaction plane M2.

The reaction force interaction planes M1 and M2 may mean the same plane on which the link arm 160 applies a force for pushing the first swash plate arm 130 outward. In more detail, the reaction force interaction planes M1 and M2 may be the same plane on which the link pins 161 of the link arm 160 apply a force for pushing an inner circumferential surface of the first swash plate arm hole 133 of the first swash plate arm 130 outward.

Further, when the portion of the first tip portion 132, which intersects the first reaction force interaction plane M1 when the inclination angle of the swash plate 91 is the maximum angle (e.g., an angle of $\alpha$), is referred to as a first boundary portion D1 and the portion of the first tip portion 132, which intersects the second reaction force interaction plane M2 when the inclination angle of the swash plate 91 is the minimum angle (e.g., an angle of approximately 0°), is referred to as second boundary portion D2, the heat-treated part 150 may be provided on a portion that includes the first boundary portion D1 and the second boundary portion D2. Particularly, the heat-treated part 150 may be provided between the first boundary portion D1 and the second boundary portion D2.

When the swash plate 91 has the maximum inclination angle, the reaction force interaction plane is positioned on the plane M1. Further, when the swash plate 91 has the minimum inclination angle, the reaction force interaction plane is positioned on the plane M2. When the inclination angle of the swash plate 91 is changed from the maximum inclination angle to the minimum inclination angle, the position of the link arm 160 is changed from the position inclined with respect to the shaft 94 to the position parallel to the shaft 94, such that the reaction force interaction plane is also changed from M1 to M2.

Meanwhile, when imaginary planes on which the center point of the first swash plate arm hole 133 and the swash plate 91 are disposed to be perpendicular to each other are referred to as perpendicular planes H1 and H2, the heat-treated part 150 may be provided on a portion of the first tip portion 132 that includes the perpendicular planes H1 and H2.

In more detail, when a perpendicular plane defined by the center point of the first swash plate arm hole 133 and the swash plate 91 when the inclination angle of the swash plate 91 is largest is referred to as the first perpendicular plane H1 and a perpendicular plane defined by the center point of the first swash plate arm hole 133 and the swash plate 91 when the inclination angle of the swash plate 91 is smallest is referred to as the second perpendicular plane H2, the heat-treated part 150 may be provided on the portion of the first tip portion 132 that includes the first perpendicular plane H1 and the second perpendicular plane H2.

The perpendicular plane defined by the center point B of the first swash plate arm hole 133 and the swash plate 91 is positioned on the plane H1 when the swash plate 91 has the maximum inclination angle, and the perpendicular plane defined by the center point B of the first swash plate arm hole 133 and the swash plate 91 is positioned on the plane H2 when the swash plate 91 has the minimum inclination angle.

When the inclination angle of the swash plate 91 is changed from the maximum inclination angle to the minimum inclination angle, the perpendicular plane is moved from the plane H1 to the plane H2.

Therefore, in consideration of both a position movement range of the link arm 160 and a position movement range of a first swash plate arm 130, a region in which a reaction force is applied to the first swash plate 91 by the link arm 160 is a region that includes the reaction force interaction planes M1 and M2 and the perpendicular planes H1 and H2 and is provided between the first and second boundary portions D1 and D2.

Consequently, the portion, which intersects the first reaction force interaction plane M1 when the inclination angle of the swash plate 91 is largest, is the first boundary portion D1 and the portion, which intersects the second reaction force interaction plane M2 when the inclination angle of the swash plate 91 is smallest, is the second boundary portion D2, such that the heat-treated part 150 is provided on the portion that includes the first boundary portion D1 and the second boundary portion D2.

From another point of view, as illustrated in FIG. 4, the portion, which intersects the first reaction force interaction plane M1 when the inclination angle of the swash plate 91 is largest, is the first boundary portion D1 and the portion, which also intersects the first perpendicular plane H2 when the inclination angle of the swash plate 91 is largest, is the second boundary portion D2, such that the heat-treated part 150 is provided on the portion that includes the first boundary portion D1 and the second boundary portion D2.

As described above, the heat-treated part 150 is provided in consideration of the positional relationship between the link arm 160 and the first swash plate arm 130 at the maximum inclination angle of the swash plate 91 and the minimum inclination angle of the swash plate 91, thereby improving wear resistance of the first swash plate arm 130.

Figure 5:
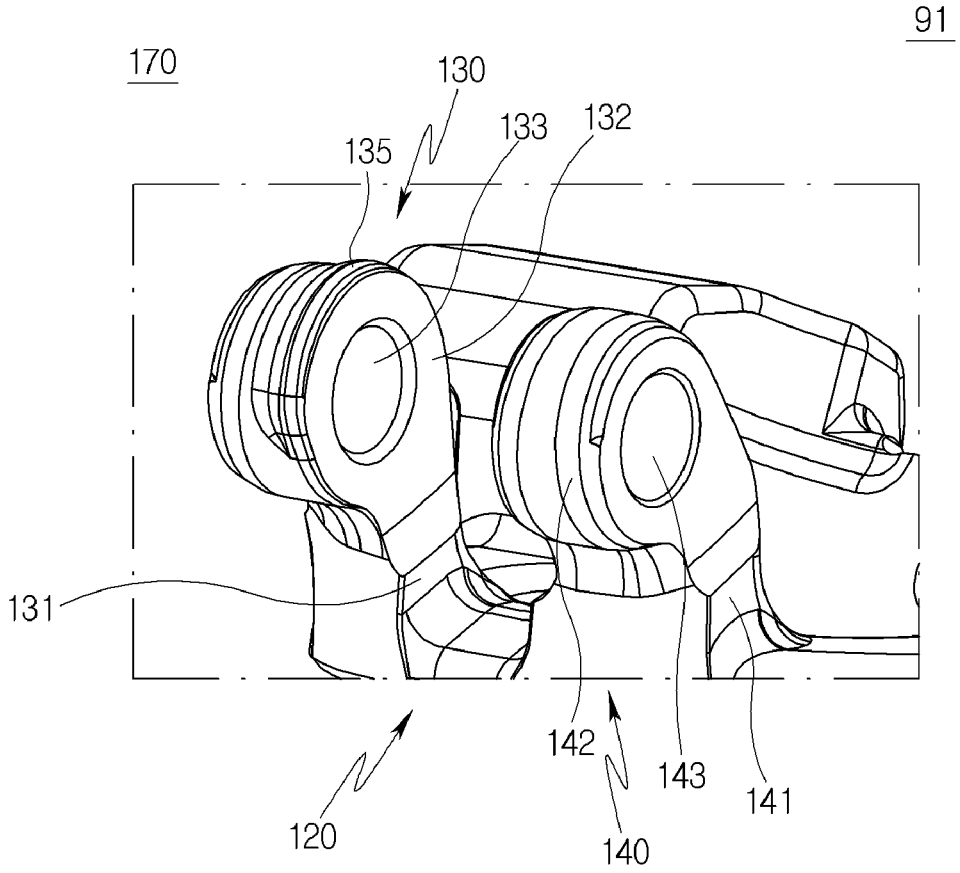
FIG. 5 is a view illustrating a state in which an area of a facing surface of the swash plate arm according to the present disclosure, which is disposed at a side in a rotation direction of the swash plate, is formed to be relatively large.
Figure 6:
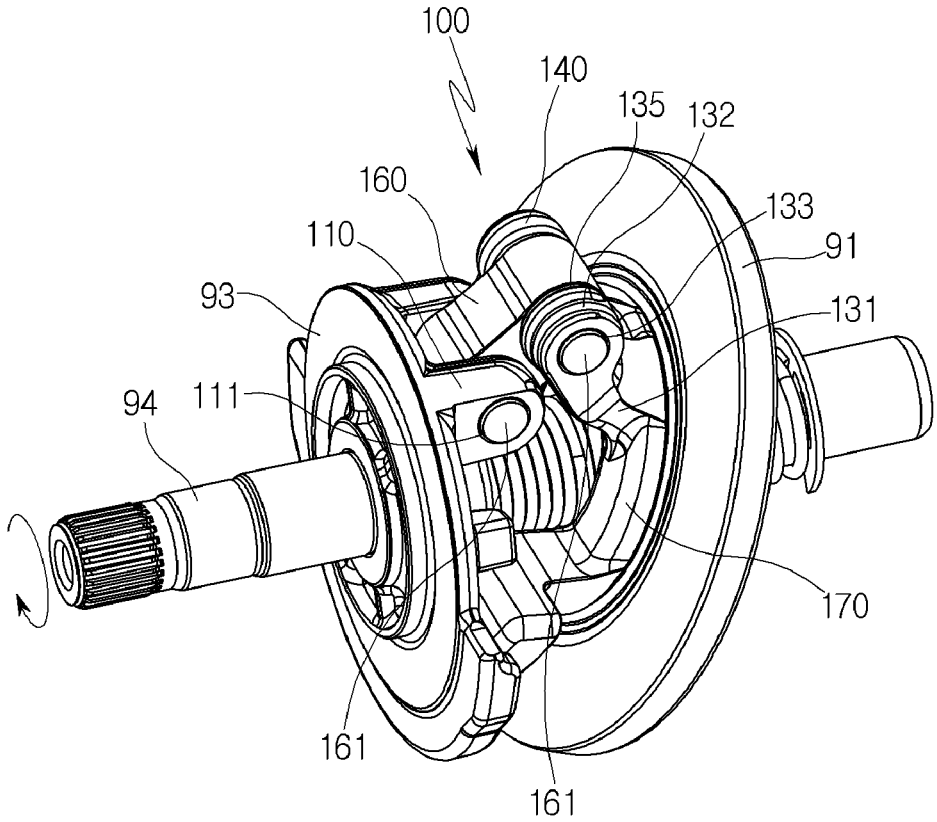
FIG. 6 is a view illustrating a portion where the area of the facing surface of the swash plate arm of the pair of swash plate arms according to the present disclosure is formed to be relatively large in respect to the rotation direction of the swash plate.
Figure 7:
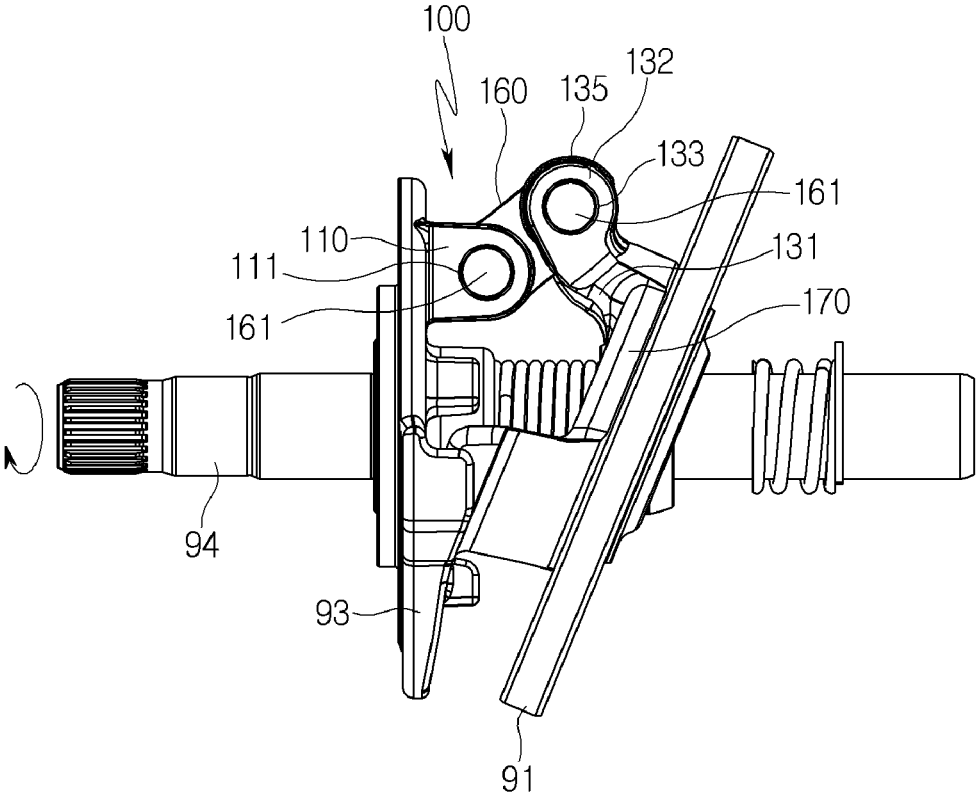
FIG. 7 is a view illustrating a portion of the facing surface of the swash plate arm according to the present disclosure in respect to the inclination angle of the swash plate.

Meanwhile, FIG. 5 is a view illustrating a state in which an area of the facing surface of the swash plate arm 120 according to the present disclosure, which is disposed at the side in the rotation direction of the swash plate 91, is formed to be relatively large, FIG. 6 is a view illustrating a portion where the area of the facing surface of the swash plate arm of the pair of swash plate arms 120 according to the present disclosure is formed to be relatively large in respect to the rotation direction of the swash plate 91, and FIG. 7 is a view illustrating a portion of the facing surface of the swash plate arm 120 according to the present disclosure in respect to the inclination angle of the swash plate 91.

In a second embodiment of the present disclosure, the configuration in which the first swash plate arm 130 has higher wear resistance than the second swash plate arm 140 may be a configuration in which a size of the first swash plate arm 130 is larger than a size of the second swash plate arm 140. That is, a resistive force against the rotational force and load is improved by increasing a size and a thickness of the first swash plate arm 130 which is disposed at the side in the rotation direction of the shaft 94 and has the facing surface that faces the link arm 160 and receives the relatively high rotational force and load.

More particularly, an area of the facing surface of the first swash plate arm 130, which faces the link arm 160, may be larger than an area of the facing surface of the second swash plate arm 140 which faces the link arm 160.

When the rotor 93 rotates integrally with the rotation of the shaft 94, the link arm 160 connecting the rotor arms 110 and the swash plate arms 120 rotates the swash plate 91 by receiving the rotational force. In this case, since the first swash plate arm 130 is disposed at the side in the rotation direction of the swash plate 91 and the second swash plate arm 140 is disposed at the side in the direction opposite to the rotation direction of the swash plate 91, the link arm 160 applies a high contact pressure to the facing surface of the first swash plate arm 130 instead of the facing surface of the second swash plate arm 140.

When the contact pressure is consistently applied, the facing surface of the first swash plate arm 130 is more severely abraded than the facing surface of the second swash plate arm 140.

Therefore, the area of the facing surface of the first swash plate arm 130, which faces the link arm 160, is larger than the area of the facing surface of the second swash plate arm 140 which faces the link arm 160, such that wear resistance of the first swash plate arm 130 disposed at the side in the rotation direction of the swash plate 91 is improved.

More specifically, the first swash plate arm 130 may include the first base portion 131 and the first tip portion 132. The first base portion 131 may be a portion connected to the swash plate 91. The first tip portion 132 may be a portion protruding from the first base portion 131 toward the rotor 93, and the first swash plate arm hole 133, to which the link pin 161 is coupled, may be formed in the first tip portion 132.

Further, the second swash plate arm 140 may include the second base portion 141 and the second tip portion 142. The second base portion 141 may be a portion connected to the swash plate 91. The second tip portion 142 may be a portion protruding from the second base portion 141 toward the rotor 93, and the second swash plate arm hole 143, to which the link pin 161 is coupled, may be formed in the second tip portion 142.

In this case, an increased area part 135 may be formed on the facing surface of the first tip portion 132, which faces the link arm 160 so that the facing surface of the first tip portion 132, which faces the link arm 160, has higher wear resistance than the facing surface of the second tip portion 142 which faces the link arm 160.

Since the increased area part 135 is disposed, the increased area part 135 may additionally disperse a force thus to reduce an abrasion rate when the link arm 160 transmits the rotational force to the first swash plate arm 130, even though the first tip portion 132 of the first swash plate arm 130, which corresponds to the facing surface facing the link arm 160, has an increased facing area and thus receives the high contact pressure.

Figure 8:
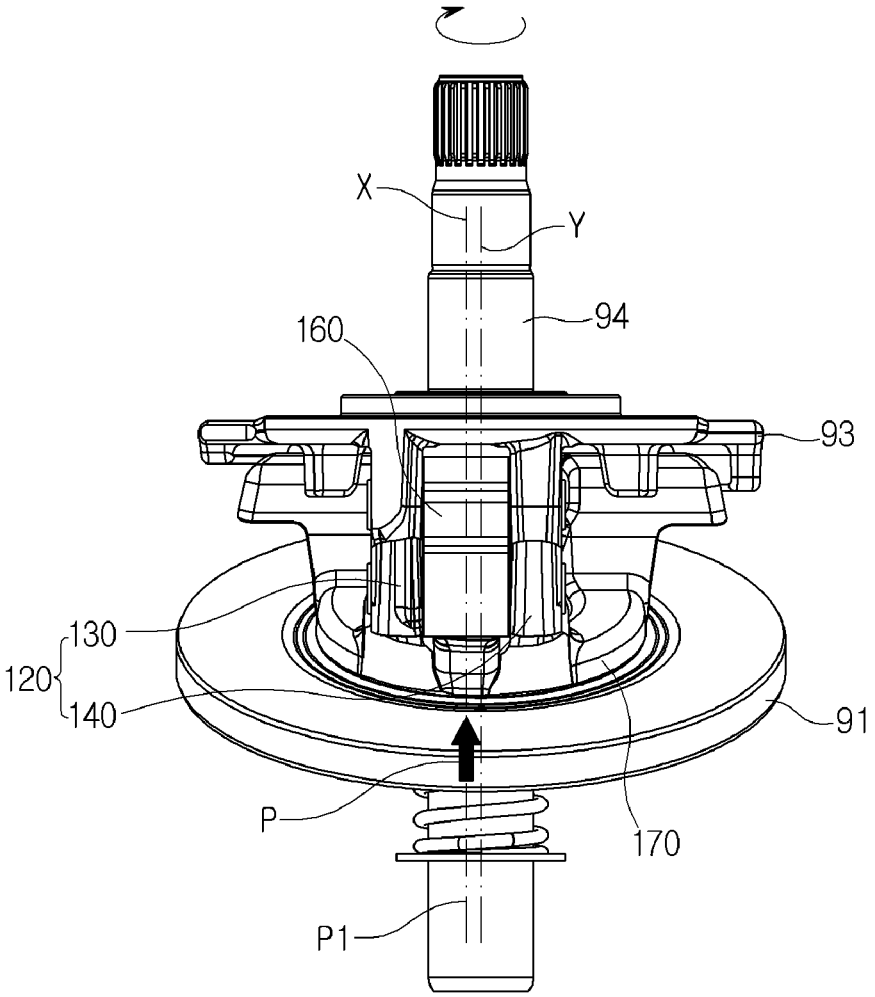
FIG. 8 is a view illustrating a state in which a center of a link arm is disposed to be eccentric with respect to a center of a shaft in the rotation direction of the swash plate in the present disclosure.

Meanwhile, FIG. 8 is a view illustrating a state in which a center of the link arm 160 is disposed to be eccentric with respect to a center of shaft 94 in the rotation direction of the swash plate 91 in the present disclosure.

In the embodiment of the present disclosure, a coupling centerline X of the rotor arm 110 and the swash plate arm 120 may be disposed to be eccentric in the rotation direction of the shaft 94 with respect to a centerline Y of the shaft 94.

In the swash plate compressor, a compressive force is transmitted from the swash plate 91 to the piston 70, thereby compressing the refrigerant in the cylinder bore 22. In this case, a compressive reaction force P is applied, as a reaction force, to the swash plate 91 from the piston 70. Strictly speaking, because the multiple pistons 70 are typically disposed, the force means a resultant force of the compressive reaction force P.

Typically, since the plurality of pistons 70 is disposed around the shaft 94, the compressive reaction force P is generated at a position spaced apart from the centerline Y of the shaft 94 in the rotation direction of the shaft 94 at a predetermined distance due to the positional relationship between the shoe 62 of the swash plate 91 and the piston 70 that operate in conjunction with each other.

The compressive reaction force P, which is applied to the swash plate 91 through the shoe 62 from the piston 70, is transmitted to the rotor arms 110 through the link arm 160 from the swash plate arms 120.

If the position of the coupling centerline X of the rotor arm 110 and the swash plate arm 120 coincides with the centerline Y of the shaft 94, the position on the swash plate 91 to which the compressive reaction force P is applied by the piston 70 and the position of the link arm 160 are not positioned on the same line, and as a result, it is impossible to appropriately withstand the compressive reaction force P.

For this reason, there occurs a problem in that the link pin 161 for connecting the link arm 160 to the swash plate arms 120 or the rotor arms 110 is easily damaged and abraded due to the imbalanced compressive reaction force.

In the embodiment of the present disclosure, in order to effectively withstand the compressive reaction force P applied to the swash plate 91 by the piston 70, the coupling centerline Y of the rotor arm 110 and the swash plate arm 120 may be positioned on a portion on which the shoe 62, by which the swash plate 91 and the piston 70 operate in conjunction with each other, is disposed.

That is, the position of the rotor arm 110 on the rotor 93 and the position of the swash plate arm 120 on the swash plate 91 may be spaced apart from the centerline Y of the shaft 94 in the rotation direction of the shaft 94 and positioned within a range in which the compressive reaction force P applied from the piston 70 to the swash plate 91 is generated by the inclined rotation of the swash plate 91. Strictly speaking, the coupling centerline of the rotor arm and the swash plate arm may coincide with an interaction line P1 on which the compressive reaction force P is generated.

With the above-mentioned arrangement, the compressive reaction force P is stably supported by the swash plate arms 120 and the rotor arms 110 disposed on the same line or the parallel lines and by the link arm 160 and the link pins 161 that connect the swash plate arms 120 and the rotor arms 110.

Figure 9:
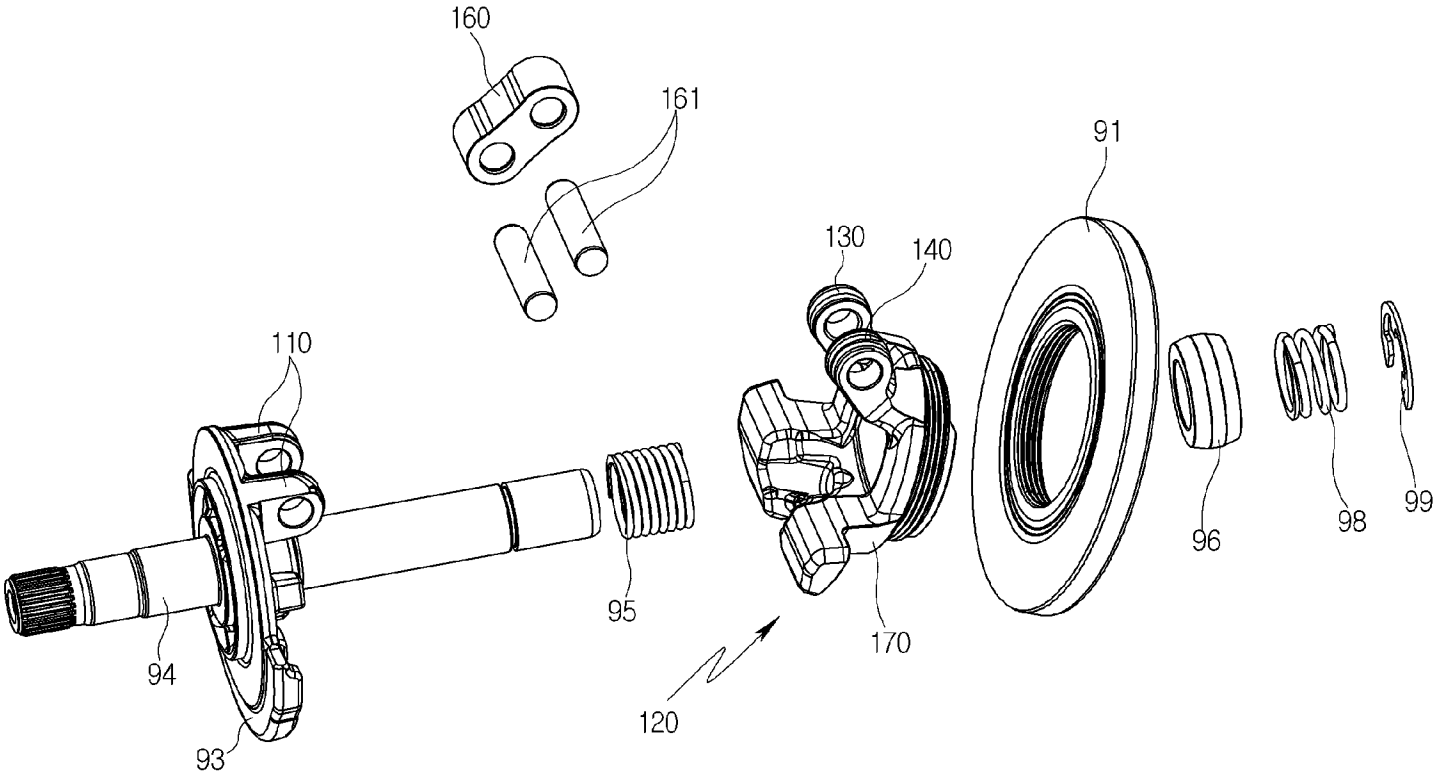
FIG. 9 is an exploded perspective view of the present disclosure.

Meanwhile, FIG. 9 is an exploded perspective view of the present disclosure. Referring to FIG. 9, the rotor 93 is mounted on a part of the outer circumferential surface of the shaft 94, and the pair of rotor arms 110 is disposed on the rotor 93.

Further, a screw thread is formed on an inner through portion of the swash plate 91, and a screw thread is also formed at one end of the swash plate arm 120, such that a manufacturer may fasten and couple the swash plate arms 120 to the swash plate 91 by rotating and fitting the swash plate arms 120 into the inner through portion of the swash plate 91. As described above, the swash plate arms 120 include the first and second swash plate arms 130 and 140. As described above, the heat-treated part 150 or the increased area part 135 may be provided on the first swash plate arm 130.

In addition, the first and second swash plate arms 130 and 140 and the rotor arm 110 are connected with the link arm 160 and the link pins 161.

Next, a first return spring 95 is fitted in an axial direction of the shaft 94, and an axis of the shaft 94 is disposed to penetrate a through portion formed at a center of the swash plate arms 120. The first return spring 95 is disposed at one side of the swash plate 91 and provides an elastic force in a direction in which the inclination angle of the swash plate 91 is minimized.

Further, a bushing 96 is disposed to be in contact with an end of the first return spring 95 in the axial direction of the shaft 94, the shaft 94 is inserted into a hollow hole of the bushing 96, and the bushing 96 is disposed on the axis of the shaft 94. The swash plate arms 120 are formed on an outer circumferential surface of the bushing 96.

In addition, a retainer 99 is coupled to the other side of the shaft 94, and a second return spring 98 is disposed between the bushing 96 and the retainer 99. The second return spring 98 is disposed at the other side of the swash plate 91 and provides an elastic force in a direction in which the inclination angle of the swash plate 91 is minimized. That is, the first and second return springs 95 and 98 are disposed at both sides of the swash plate 91, respectively, and provide the elastic forces in the direction in which the inclination angle of the swash plate 91 is minimized.

The foregoing description is provided only for explaining the specific embodiments of the swash plate compressor.

Accordingly, it is noted that those skilled in the art can easily ascertain that the present disclosure may be substituted or modified in various forms without departing from the scope of the present disclosure.

The present disclosure relates to the swash plate compressor and is industrially available.

The invention claimed is:

1. A swash plate compressor comprising:
- a casing;
- a shaft rotatably disposed in the casing;
- a rotor fastened to the shaft and configured to rotate integrally with the shaft;
- a swash plate configured to rotate integrally with the rotor;
- a piston configured to reciprocate in a cylinder bore formed in the casing, the piston connected to the swash plate, the piston configured to define a compression chamber together with the cylinder bore; and
- an inclination adjusting means disposed between and connecting the rotor and the swash plate, the inclination adjusting means configured to adjust an inclination angle of the swash plate in accordance with rotation of the rotor,
- wherein the inclination adjusting means comprises:
  - rotor arms protruding from the rotor toward the swash plate and having rotor arm holes;
  - swash plate arms protruding from the swash plate toward the rotor and having swash plate arm holes; and
  - a link arm hingedly coupled to the rotor arms and the swash plate arms by link pins,
  - wherein the swash plate arms comprise:
    - a first swash plate arm positioned at a side in a rotation direction of the shaft based on the link arm; and
    - a second swash plate arm positioned at a side in a direction opposite to the rotation direction of the shaft based on the link arm, wherein the first swash plate arm has higher wear resistance than the second swash plate arm.

2. The swash plate compressor of claim 1, wherein the first swash plate arm comprises a heat-treated part.

3. The swash plate compressor of claim 2, wherein the first swash plate arm further comprises:
- a first base portion connected to the swash plate;
- a first tip portion protruding from the first base portion toward the rotor and having a first swash plate arm hole; and
- the heat-treated part provided on the first tip portion, and
- wherein the second swash plate arm comprises:
  - a second base portion connected to the swash plate; and
  - a second tip portion protruding from the second base portion toward the rotor and having a second swash plate arm hole.

4. The swash plate compressor of claim 3, wherein when imaginary planes comprising a center point of a first one of the rotor arm holes and a center point of the first swash plate arm hole are referred to as reaction force interaction planes, the heat-treated part is provided on a portion of the first tip portion that includes the reaction force interaction planes.

5. The swash plate compressor of claim 4, wherein when a first one of the reaction force interaction planes defined by the center point of the first one of the rotor arm holes and the center point of the first swash plate arm hole when the inclination angle of the swash plate is largest is referred to as a first reaction force interaction plane and the first one of the reaction force interaction planes defined by the center point of the first one of the rotor arm holes and the center point of the first swash plate arm hole when the inclination angle of the swash plate is smallest is referred to as a second reaction force interaction plane, the heat-treated part is provided on a portion of the first tip portion that includes the first reaction force interaction plane and the second reaction force interaction plane.

6. The swash plate compressor of claim 5, wherein when imaginary planes on which the center point of the first swash plate arm hole and the swash plate are disposed to be perpendicular to each other are referred to as perpendicular planes, the heat-treated part is provided on a portion of the first tip portion that includes the perpendicular planes.

7. The swash plate compressor of claim 6, wherein when a first one of the perpendicular planes defined by the center point of the first swash plate arm hole and the swash plate when the inclination angle of the swash plate is largest is referred to as a first perpendicular plane and a second one of the perpendicular planes defined by the center point of the first swash plate arm hole and the swash plate when the inclination angle of the swash plate is smallest is referred to as a second perpendicular plane, the heat-treated part is provided on a portion of the first tip portion that includes the first perpendicular plane and the second perpendicular plane.

8. The swash plate compressor of claim 7, wherein when a portion of the first tip portion which intersects the first reaction force interaction plane when the inclination angle of the swash plate is largest is referred to as a first boundary portion and a portion of the first tip portion which intersects the second reaction force interaction plane when the inclination angle of the swash plate is smallest is referred to as a second boundary portion, the heat-treated part is provided on a portion that includes the first boundary portion and the second boundary portion.

9. The swash plate compressor of claim 7, wherein when a portion of the first tip portion which intersects the first reaction force interaction plane when the inclination angle of the swash plate is largest is referred to as a first boundary portion and a portion of the first tip portion which intersects the first perpendicular plane when the inclination angle of the swash plate is largest is referred to as a second boundary portion, the heat-treated part is provided on a portion that includes the first boundary portion and the second boundary portion.

10. The swash plate compressor of claim 2, wherein the heat-treated part is heat-treated by a high-frequency heat treatment or a laser heat treatment.

11. The swash plate compressor of claim 1, wherein a size of the first swash plate arm is larger than a size of the second swash plate arm.

12. The swash plate compressor of claim 11, wherein an area of a facing surface of the first swash plate arm, which faces the link arm, is larger than an area of a facing surface of the second swash plate arm which faces the link arm.

13. The swash plate compressor of claim 12, wherein the first swash plate arm further comprises:

a first base portion connected to the swash plate; and a first tip portion protruding from the first base portion toward the rotor and having a first swash plate arm hole, wherein the second swash plate arm comprises:

a second base portion connected to the swash plate; and a second tip portion protruding from the second base portion toward the rotor and having a second swash plate arm hole, wherein an increased area part is provided on a facing surface of the first tip portion which faces the link arm.

14. The swash plate compressor of claim 1, wherein a coupling centerline of a first one of the rotor arms and a first one of the swash plate arms is eccentric in the rotation direction of the shaft with respect to a centerline of the shaft.

15. The swash plate compressor of claim 14, wherein the coupling centerline of the first one of the rotor arms and the first one of the swash plate arms is positioned within a range in which a compressive reaction force of the piston, which performs compression in accordance with an inclined rotation of the swash plate, is applied.

* * * * *